US007524402B2

(12) United States Patent
Wildfong et al.

(10) Patent No.: US 7,524,402 B2
(45) Date of Patent: Apr. 28, 2009

(54) GAP TYPE FORMING SECTION FOR A TWO FABRIC PAPER MAKING MACHINE

(75) Inventors: Vaughn Wildfong, East Longmeadow, MA (US); Richard Pitt, Almonte (CA)

(73) Assignee: AstenJohnson, Inc., Charleston, SC (US)

( * ) Notice: Subject to any disclaimer, the term of this patent is extended or adjusted under 35 U.S.C. 154(b) by 380 days.

(21) Appl. No.: 10/570,112

(22) PCT Filed: Dec. 22, 2003

(86) PCT No.: PCT/US03/40887

§ 371 (c)(1), (2), (4) Date: Mar. 1, 2006

(87) PCT Pub. No.: WO2005/068714

PCT Pub. Date: Jul. 28, 2005

(65) Prior Publication Data

US 2006/0175031 A1 Aug. 10, 2006

(51) Int. Cl.
*D21F 1/00* (2006.01)
*D21F 1/48* (2006.01)
*D21F 1/52* (2006.01)

(52) U.S. Cl. ..... 162/301; 162/300; 162/352; 162/363; 162/364

(58) Field of Classification Search ..... 162/203, 162/300, 301, 303, 304, 351, 352, 363, 364, 162/374

See application file for complete search history.

(56) References Cited

U.S. PATENT DOCUMENTS 3,232,825 A 2/1966 Robinson
3,438,854 A 4/1969 Means
3,944,464 A * 3/1976 Means ..... 162/273
4,532,008 A 7/1985 Creagan et al.
4,908,102 A 3/1990 Zag et al.
4,999,087 A * 3/1991 Ebihara et al. ..... 162/301
5,074,996 A 12/1991 Galanty et al.
5,201,999 A * 4/1993 Field et al. ..... 162/301
5,389,206 A 2/1995 Buck et al.
5,489,365 A 2/1996 Wahlstrom (Continued)

FOREIGN PATENT DOCUMENTS

CA 2118413 4/1995

(Continued)

*Primary Examiner*—Eric Hug
(74) *Attorney, Agent, or Firm*—Volpe and Koenig, P.C.

(57) ABSTRACT

A twin fabric gap former forming section for paper making machine is described in which: the pitch of the fabric support elements d decreases progressively in the machine direction; the level of vacuum applied to the forming fabrics through the dewatering boxes increases in the machine direction; the two forming fabrics together with the stock sandwiched between them traverse at least four separate and distinct vacuum zones within the forming section as they proceed in the machine direction; the level of vacuum applied to the last of the at least four separate and distinct vacuum zones is higher than the level of vacuum applied to the first of the separate and distinct vacuum zones; the level of vacuum applied to the at least four separate and distinct vacuum zones follows a preselected profile; and the dewatering boxes carrying the fabric support elements are arranged so that the fabric support elements are located in an alternating sequence on the machine sides of both of the forming fabrics.

14 Claims, 10 Drawing Sheets

U.S. PATENT DOCUMENTS

| | | | |
|---|---|---|---|
| 5,500,091 | A | 3/1996 | Buck et al. |
| 5,593,546 | A | 1/1997 | Ilvespaa et al. |
| 5,599,427 | A | 2/1997 | Koivuranta et al. |
| 5,607,555 | A | 3/1997 | Grossmann et al. |
| 5,635,033 | A | 6/1997 | Grossmann et al. |
| 5,647,958 | A | 7/1997 | Schmidt-Rohr et al. |
| 5,656,133 | A | 8/1997 | Savia |
| 5,718,805 | A | 2/1998 | Egelhof et al. |
| 5,730,841 | A | 3/1998 | Wanke |
| 5,766,419 | A | 6/1998 | Linsuri et al. |
| 5,798,024 | A | 8/1998 | Odell et al. |
| 5,833,809 | A | 11/1998 | Odell |
| 6,669,820 | B2 | 12/2003 | Odell |
| 2002/0108732 | A1 * | 8/2002 | Grabsoheid et al. ..... 162/302 |

FOREIGN PATENT DOCUMENTS

| | | |
|---|---|---|
| EP | 0 296 135 | 12/1988 |
| EP | 0 688 900 | 12/1995 |

* cited by examiner

GAP TYPE FORMING SECTION FOR A TWO FABRIC PAPER MAKING MACHINE

BACKGROUND

This invention relates to a two fabric gap type forming section for use in a paper making machine, in which the stock is injected from a head box slice directly into the gap between the two moving forming fabrics. The forming section of this invention thus does not include an earlier open surface section using only one forming fabric. This invention is concerned with that portion of the forming section between the locus at which the forming fabrics come together to sandwich the stock between them and the locus at which the two forming fabrics separate with the stock continuing on one of them. This invention is appropriate for use in both two fabric forming section rebuilds and in newly constructed gap type forming sections.

In a gap type forming section in a paper making machine, the two forming fabrics do not follow a linear path. The fabrics together pass over a sequence of rolls and dewatering boxes which are located on alternate sides of the two fabrics and thus define the sinuous path of the two fabrics. Each dewatering box has a curved surface, which carries a group of fabric support elements, such as blades, which are in contact with the machine sides of the forming fabrics. Each dewatering box may also be connected to a source of controlled vacuum. These curved surfaces cause the moving forming fabrics to follow the desired sinuous path. The application of a controlled level of vacuum to the dewatering boxes has two effects: it promotes the removal of water from the stock between the two moving forming fabrics, and it deflects the path of the two moving forming fabrics into the gaps between the fabric support elements. This deflection of the two moving forming fabrics generates a positive pressure pulse within the stock layer sandwiched between them that creates fluid movement within the stock in the machine direction; this causes a shearing action within the stock which serves to break up fibre flocs.

The actual magnitude of each pressure pulse generated by the deflection angle of the moving forming fabrics at the edges of each fabric support element has a significant impact on the quality of the final sheet produced. The strength of the pressure pulse generated by each fabric support element should be chosen to match the stock conditions and properties at that fabric support element. Hence, there exists a need to be able to modify the strength and/or magnitude of the pressure pulses as more water is drained from the stock and the incipient paper web is formed.

Poor control of the fabric deflection within the forming section has been found to have an adverse effect on the formation process, which will in turn have a negative impact on the quality of the paper product being made.

The actual fabric deflection angle at the edge of each fabric support element in an operating twin fabric forming section has been found to be controlled by several factors. These include:

1. the geometric layout of the physical components used in the construction of the forming zone; including the element-to-element pitch for the fabric support elements, the machine direction width of the fabric support elements, and the radius of curvature of the surfaces to which the fabric support elements are attached;

2. the level of vacuum applied to the dewatering boxes which controls the degree to which the moving forming fabrics are deflected into the gaps between the fabric support elements; and 3. the amount of machine direction tension applied to each of the two moving forming fabrics.

As used herein, the following terms are to be taken to have the following meanings:

(i) term machine direction, or MD, refers to a direction generally parallel to the direction of movement of the two forming fabrics away from the headbox slice;

(ii) the term "pitch" refers to the center to center spacing of successive fabric supporting elements in the machine direction; and (iii) the terms "fabric support element" and "fabric support elements" refers:

either to moving surfaces such as rolls over which a forming fabric moves in rolling contact, or to static surfaces such as blades, foils or the like over which a forming fabric moves in sliding contact.

In the initial stages of sheet formation, when the level of vacuum applied to the machine side of the forming fabric, and consequently to the incipient paper web, is low, the predominant factors controlling forming fabric deflection are the geometry of the forming section and the tension applied to both of the forming fabrics. Further, although the tension applied to the two forming fabrics is usually the same, two different tension levels can be used. The two tensions are set, within the overall pattern of adjustments, to obtain the desired level of pressure pulses within the stock sandwiched between the two moving forming fabrics.

From the point at which the stock is first sandwiched between the two moving forming fabrics until the point at which the two forming fabrics separate, the consistency of the stock is continually increasing as water is drained from the incipient paper web. At the same time as the stock consistency increases, there is also a corresponding decrease in individual fiber mobility within the stock. These changes require a stronger pressure pulse to provide beneficial fiber movement which will improve the sheet properties in the incipient paper web. However, the incipient paper web eventually reaches a consistency at which no further beneficial fiber movement can occur. From that point onwards until the two moving forming fabrics separate the pressure pulse strength must be controlled by careful selection of the required vacuum level so that drainage continues, and by careful selection of the radius, fabric support element pitch and fabric support element width so that the pressure pulse strength is controlled to a level which will not damage the incipient paper web.

During the initial sheet forming period where beneficial fiber movement can still occur, the need for a larger pressure pulse may increase at a faster rate than can be achieved by control of the vacuum level applied to the forming fabrics alone. This is because the vacuum level must be limited to a value which does not cause excessive drainage which will both reduce fiber mobility and set the sheet properties before the desired formation benefits can be achieved. It is therefore essential to obtain a larger pressure pulse by causing a higher deflection of the forming fabrics at the edges of the fabric support elements by utilizing a wider pitch between them and/or by utilizing a higher radius of curvature in the structure to which the fabric contacting fabric support elements are attached, and/or by utilizing fabric support elements such as opposed blades, located to increase fabric deflection into the gaps between the fabric support elements.

SUMMARY

It is thus apparent that there is a matrix of variables which must be considered in order to optimise the quality of the sheet product. The present invention is based on the realization that the following factors must to be taken into account in the creation of an improved twin fabric gap former forming section for paper making machine:

(a) the pitch of the fabric support elements should decrease progressively in the machine direction;

(b) the level of vacuum applied to the forming fabrics through the dewatering boxes should increase in the machine direction;

(c) the two forming fabrics together with the stock sandwiched between them should traverse at least four separate and distinct vacuum zones within the forming section as they proceed in the machine direction;

(d) the level of vacuum applied to the last of the at least four separate and distinct vacuum zones must be higher than the level of vacuum applied to the first of the separate and distinct vacuum zones;

(e) the level of vacuum applied to the at least four separate and distinct vacuum zones must follow a preselected profile; and (f) the dewatering boxes carrying the fabric support elements should be arranged so that the fabric support elements are located in an alternating sequence on the machine sides of both of the forming fabrics.

Thus in a first broad embodiment this invention seeks to provide a two fabric gap type forming section for a paper making machine having a conveying forming fabric and a backing forming fabric, such that:

(i) each of the forming fabrics has a paper side and a machine side;

(ii) the forming fabrics move together in close proximity with each other in the machine direction with a layer of stock sandwiched in between;

(iii) the forming fabrics are supported by a series of fabric support elements over which the machine sides of each of the forming fabrics pass in contact, the fabric support elements being supported on a sequence of dewatering boxes, the dewatering boxes each having a curved fabric support element supporting surface; and (iv) the dewatering boxes provide separate drainage zones at least some of which are connected to a source of vacuum to provide separate vacuum zones, wherein:

(a) the forming zone comprises that portion of the forming section between the locus at which the forming fabrics come together to sandwich the stock between them and the locus at which the two forming fabrics separate with the stock continuing on one of them;

(b) the dewatering boxes provide at least four separate and distinct vacuum zones within the forming section;

(c) either: the radii of curvature of the curved surfaces supporting the fabric support elements decreases progressively in the machine direction, or: the radii of curvature of the curved surfaces supporting the fabric support elements decreases on successive supporting surfaces in the machine direction;

(d) either: the pitch of the fabric support elements within each vacuum zone is constant, and the pitch of the fabric support elements on successive vacuum zones decreases in the machine direction;

or: the pitch of successive fabric support elements within each vacuum zone decreases in the machine direction;

(e) the dewatering boxes supporting the fabric support elements are constructed and arranged to locate the fabric support elements in contact with the machine sides of the conveying forming fabric and the backing forming fabric in an alternating sequence in the machine direction;

(f) on all of the dewatering boxes:

either: all of the fabric support elements are the same width in the machine direction;

or: all of the forming fabric support elements are not the same width in the machine direction (i.e., at least some have different widths).

Preferably, the fabric support element pitch within each vacuum zone is constant, and the fabric support element pitch within successive vacuum zones decreases in the machine direction. Alternatively, the fabric support element pitch within each vacuum zone is not constant, and the fabric support element pitch within each successive vacuum zone decreases in the machine direction.

Preferably, the radii of curvature of the curved surfaces supporting the fabric support elements on successive vacuum zones decreases in the machine direction. Alternatively, the radii of curvature of the curved surfaces supporting the fabric support elements on successive vacuum zones decrease progressively in the machine direction.

Preferably, each dewatering box provides at least one vacuum zone. More preferably, at least one dewatering box provides at least two vacuum zones. Most preferably all of the dewatering boxes provide more than one vacuum zone.

Preferably, the ratio of the width of the fabric support elements to the width of the gap between them varies from about 1:10 down to about 1:0.5.

Preferably, the forming section includes a turning roll which is provided with vacuum assisted drainage. Alternatively, the forming section includes a turning roll which is not provided with vacuum assisted drainage.

BRIEF DESCRIPTION OF THE DRAWINGS

The invention will now be described with reference to the attached figures in which.

DETAILED DESCRIPTION OF THE PREFERRED EMBODIMENTS

Figure 1:
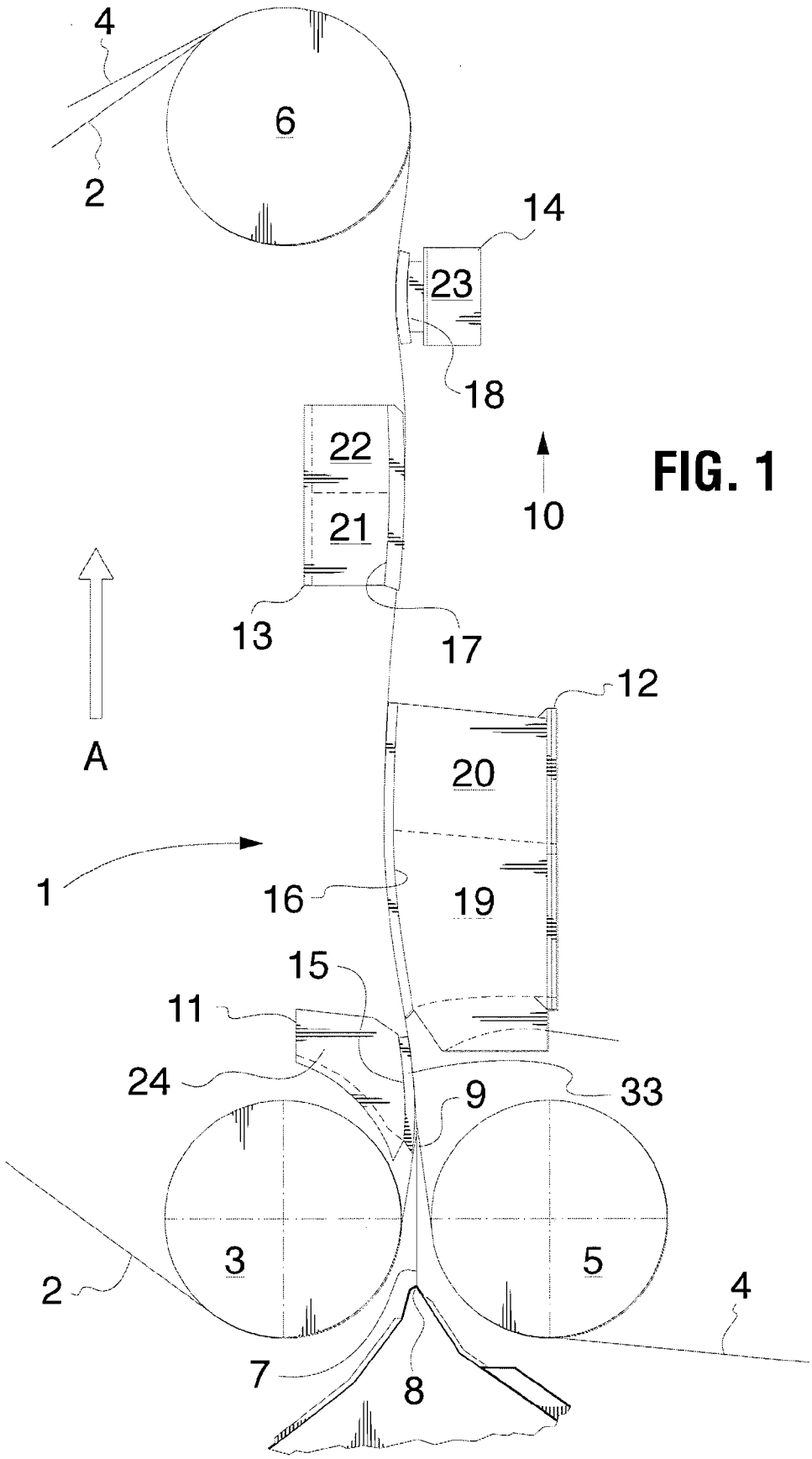
FIG. 1 shows schematically a gap type forming section according to a first embodiment of the invention.

Referring first to FIG. 1, a two fabric gap type forming section 1 is shown for a paper making machine. The forming section 1 is arranged vertically; the arrow A indicates the vertical direction.

The forming section 1 extends from the location where the conveying forming fabric 2 enters forming section 1 around the first forming roll 3, and the backing forming fabric 4 enters the forming section around the second forming roll 5, to the location where the backing and conveying forming fabrics 2 and 4 separate after passing around the turning roll 6. The two forming fabrics 2,4 have sandwiched between them within the forming section 1 a layer of stock 7 delivered from the headbox slice 8 to the impingement point 9. The two forming fabrics 2,4 move together through the forming section 1 in the machine direction as indicated by the arrow 10. It is thus apparent that the stock 7 travels upwardly through the forming section 1. As is discussed below, other arrangements are possible.

In between the first forming roll 3 together with the adjacent second forming roll 5 at one end of the forming section, and the turning roll 6 at the other, four separate dewatering boxes 11, 12, 13 and 14 are located. Each of these has a curved surface as at 15, 16, 17 and 18 which supports the fabric support elements (not shown) to provide a curved supporting surface on each of the dewatering boxes 11, 12, 13 and 14 for the forming fabrics 2,4.

As shown, these four dewatering boxes 11, 12, 13 and 14 are located on alternating sides of the forming fabrics 2, 4 so that the two forming fabrics 2,4 wrap around fabric support elements (such as fabric support elements 26, 27, 28 shown in FIG. 3), located on each of the curved supporting surfaces 15, 16, 17 and 18 in sequence as they move together in the machine direction 10 through the forming section 1.

The four dewatering boxes 11, 12, 13 and 14 are each not the same.

The first dewatering box 11 is an impingement shoe to which vacuum may be applied through a single space 24 by means of a controlled vacuum supply (not shown). A preferred impingement shoe of this type is described by Buchanan et al., in US 2003/0173048. Other known constructions may be used for the impingement shoe.

The second dewatering box 12 is divided into two separate zones 19 and 20; each of these zones 19 and 20 may have a separate controlled vacuum supply (not shown).

The third dewatering box 13 is also divided into two separate zones 21 and 22, each of these zones 21 and 22 is provided with its own controlled vacuum supply (not shown) so as to provide two separate independently controlled vacuum zones 21 and 22.

The fourth dewatering box 14 is not divided, and has only a single space 23 provided with a controlled vacuum supply (not shown). If desired, dewatering box 14 may be constructed to have two vacuum zones as shown for dewatering box 13.

It can thus be seen that these four boxes provide at least six separate controlled vacuum zones over which the two moving forming fabrics pass. In the machine direction these are in sequence zones 24, 19, 20 21, 22 and 23. These six zones are constructed and arranged to expose the two forming fabrics 2, 4, and consequently the stock 7 contained between them, to a sequence of conditions:

1. the applied vacuum ranges from a minimum of about zero in zone 24 to a maximum in zone 23;

2. the radius of curvature of the curved surfaces supporting the fabric support elements ranges from a maximum for surface 16 in zone 19 to a minimum for surface 18 in zone 23;

3. the pitch of the fabric support elements in the machine direction ranges from a maximum on surface 16 to a minimum on surface 18.

Figure 2:
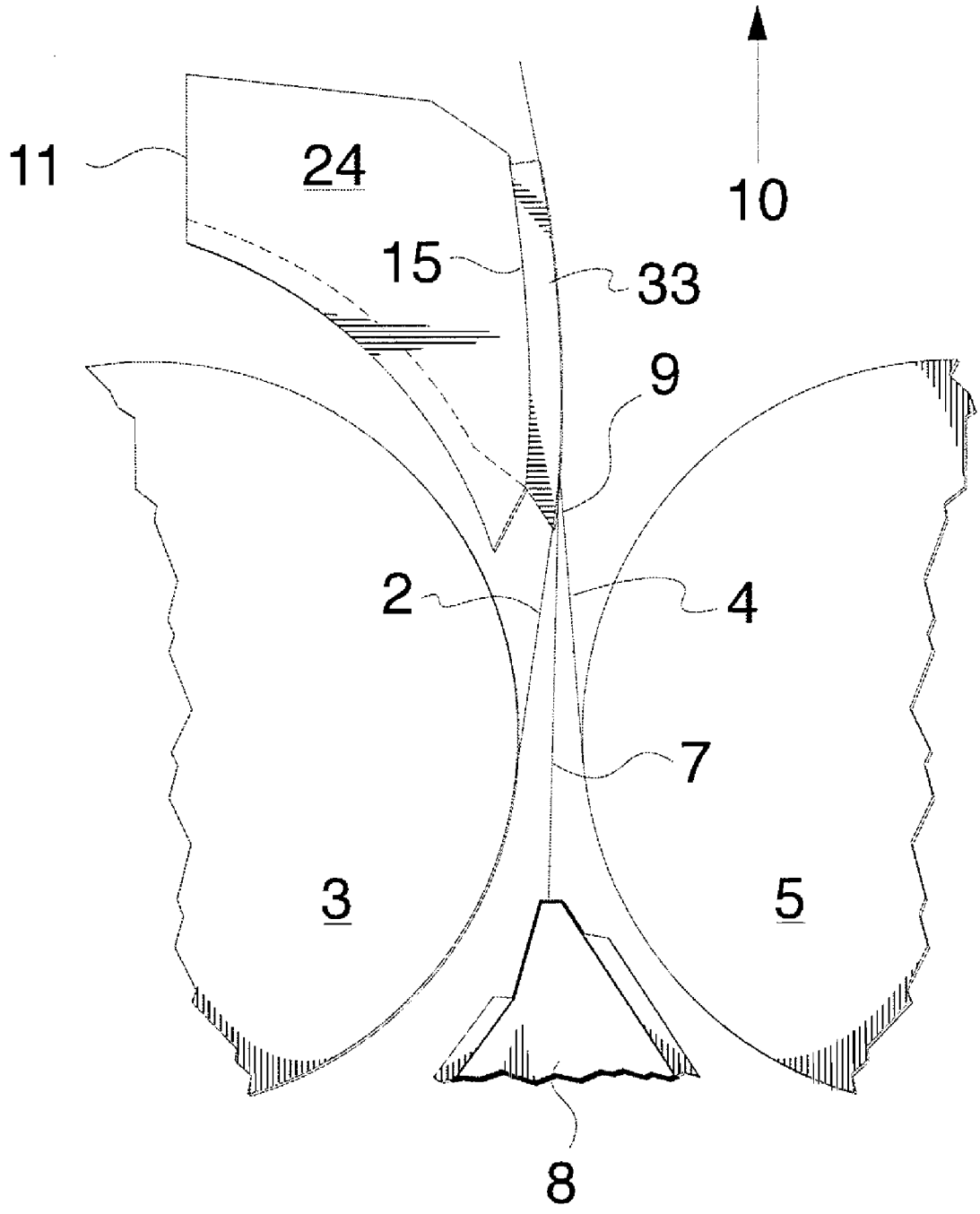
FIG. 2 shows schematically in more detail the impingement zone of FIG. 1.

FIG. 2 shows in more detail the impingement point 9 of FIG. 1. The two forming fabrics 2, 4 come together at the impingement point 9 where the stock jet 7 is injected between them. The two moving fabrics then follow a curved path determined by the paper side profile of the curved impingement shoe surface 33 located on surface 15. When an impingement shoe as described by Buchanan et al in US 2003/0173048 is used, the curved impingement shoe surface 33 comprises a series of slots (not shown) which can be oriented at an angle to the machine direction.

Figure 3:
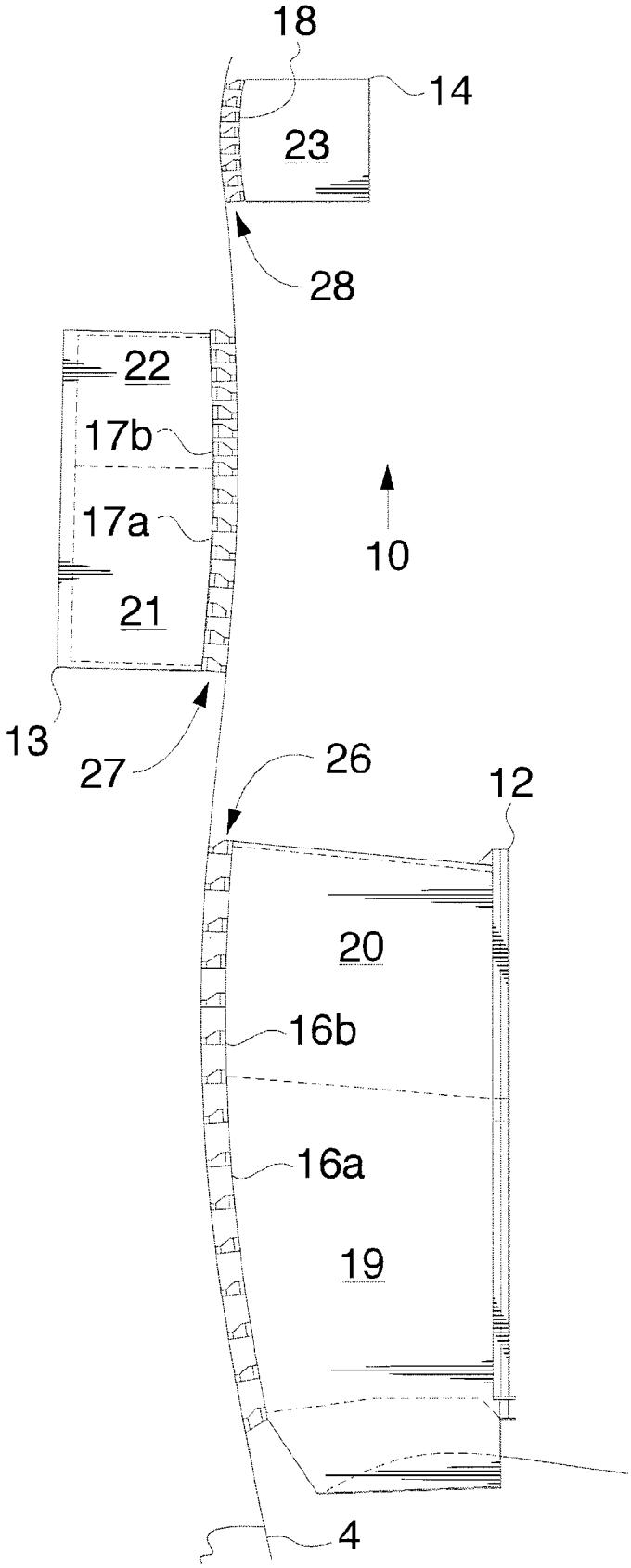
FIG. 3 shows schematically in more detail the second, third and fourth dewatering boxes of FIG. 1.

FIG. 3 shows the dewatering boxes 12, 13 and 14 of FIG. 1 in more detail. Several aspects of this set of dewatering boxes are apparent from FIG. 3.

First, it can be seen that the radius of curvature of the three curved surfaces 16*a*, 16*b*, 17*a*, 17*b* and 18 decreases in the machine direction indicated by the arrow 10.

Second, the pitch of the three sets of fabric support elements is shown more clearly. These are:

the first set as at 26 on dewatering box 12;

the second set as at 27 on dewatering box 13; and the third set as at 28 on dewatering box 14.

In these sets, the width of the fabric support element surfaces supporting the forming fabric is constant. The pitch of the fabric support elements is more complex, in that:

within each set 26, 27 and 28 as attached to the curved surfaces 16, 17 and 18 respectively the pitch is the same within each set, but the pitch used within each set decreases (i.e. becomes narrower) in the machine direction 10, so that the pitch in set 26 is wider than the pitch in set 27, and the pitch in set 27 is wider than the pitch in set 28. It is also apparent that the pitch of the fabric support elements in set 27 decreases (i.e., becomes narrower) in the machine direction 10.

Thus in the sequence of sets the pitch decreases in the machine direction, and the radius of curvature also decreases in sequence in the same direction.

Figure 4A:
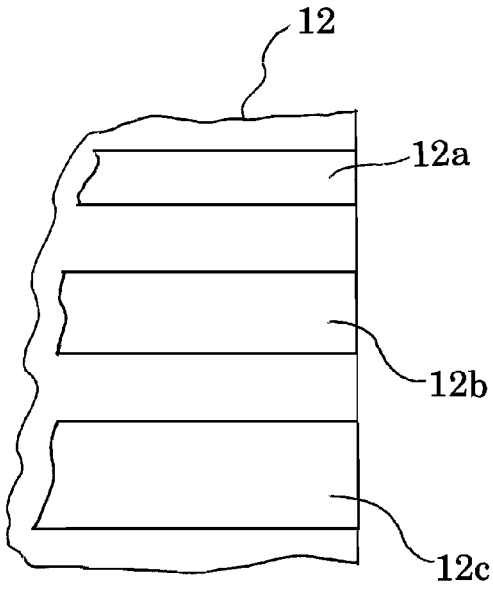
FIG. 4A shows an enlarged partial top view of a second dewatering box schematically in which portions of the fabric support elements are shown which have widths that are different in the machine direction.
Figure 4:
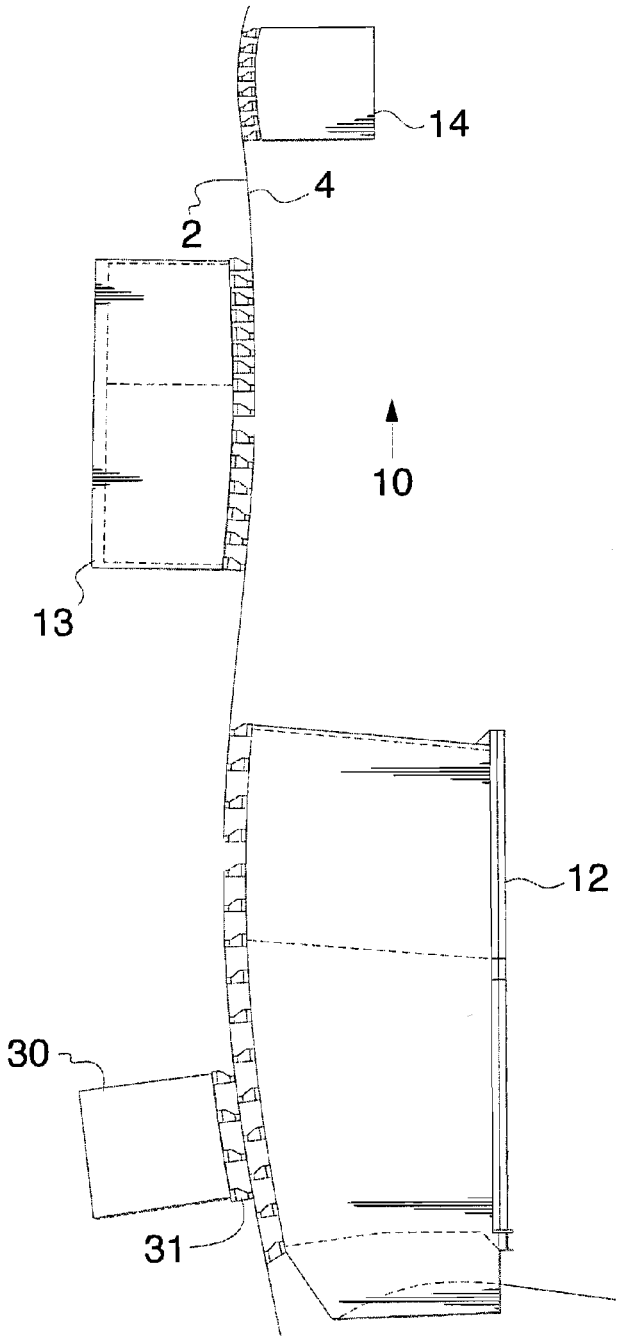
FIG. 4 shows schematically an alternative construction to FIG. 3.

In FIG. 4 an alternative construction to that of FIGS. 1 and 3 is shown. In FIGS. 1 and 3 all of the dewatering box surfaces have a convex curve, so that the two moving forming fabrics 2,4 wrap around the fabric support elements due to the tension on the two moving forming fabrics 2,4. In FIG. 4 an additional dewatering box 30 is located opposite dewatering box 12. As this dewatering box is on the outside of the convex curve of the two forming fabrics, the fabric support elements as at 31 should be provided with a flexible mounting. A suitable mounting is described by McPherson in U.S. Pat. No. 6,361,657.

In FIG. 4A, an enlarged partial top view of an alternate embodiment of the second dewatering box 12 is shown in which portions of fabric support elements 12*a*, 12*b* and 12*c* are shown which have different widths in the machine direction.

Figure 5:
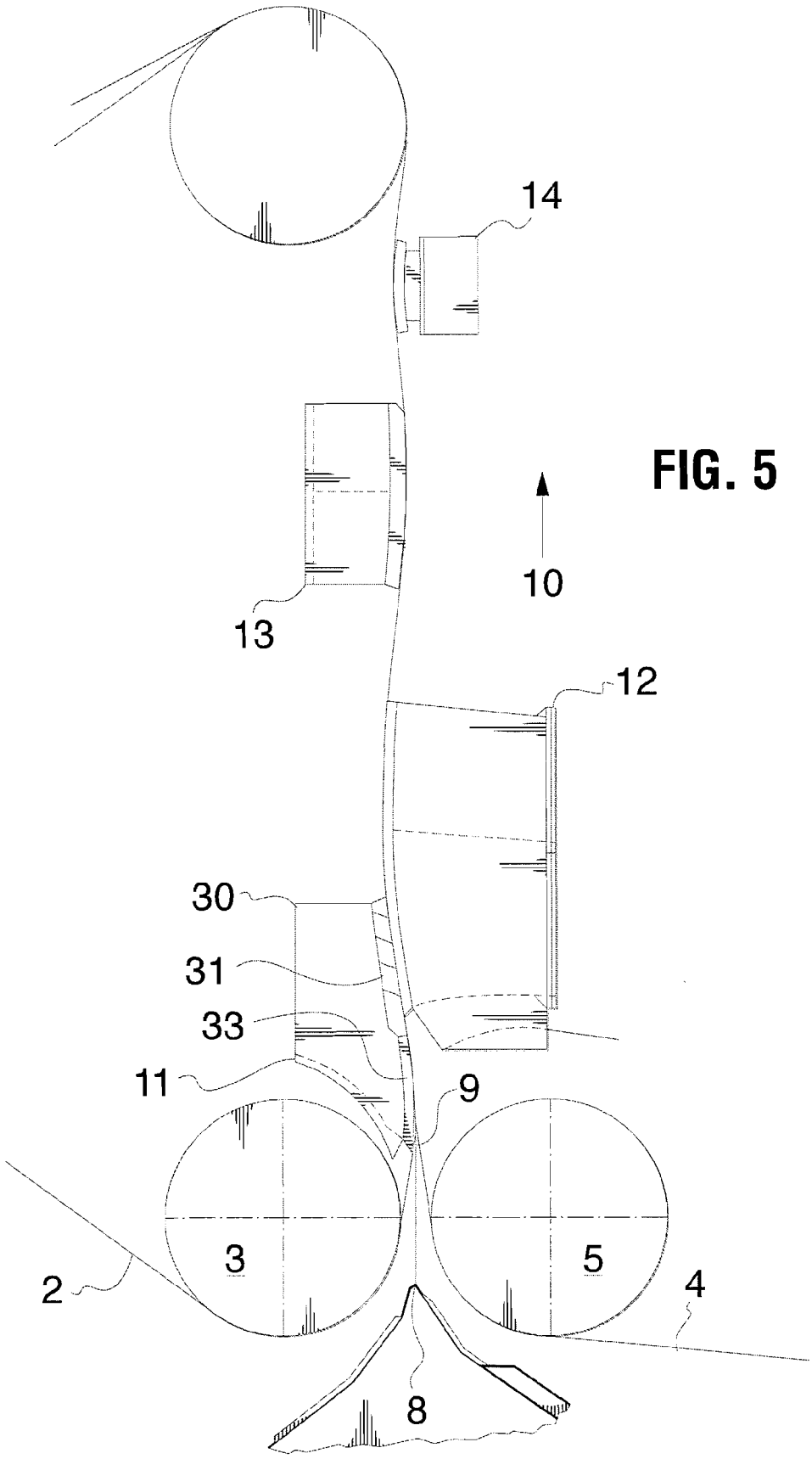
FIGS. 5, 6 and 7 show schematically further alternative arrangements for the impingement shoe shown in FIG. 1.
Figure 6:
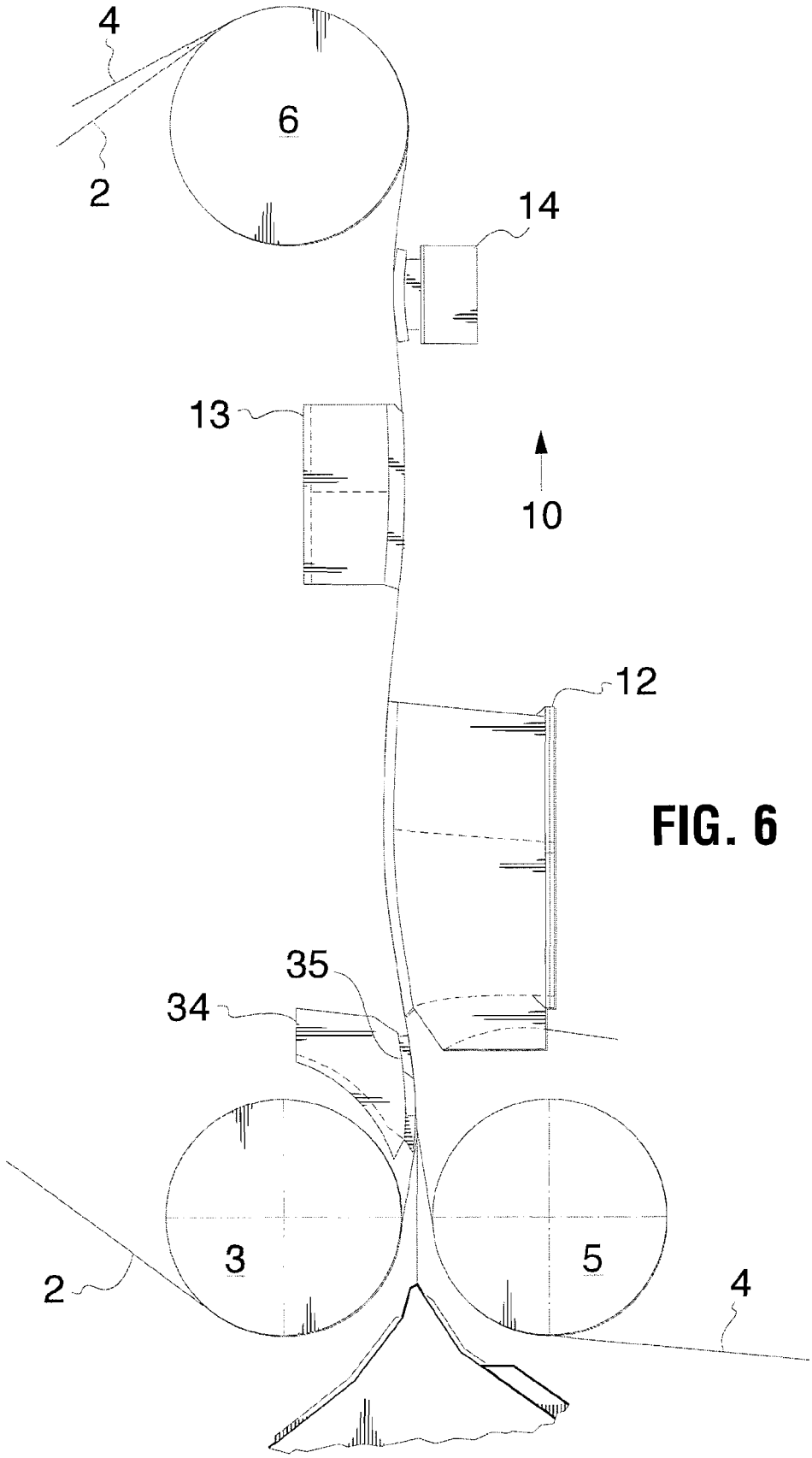
Figure 7:
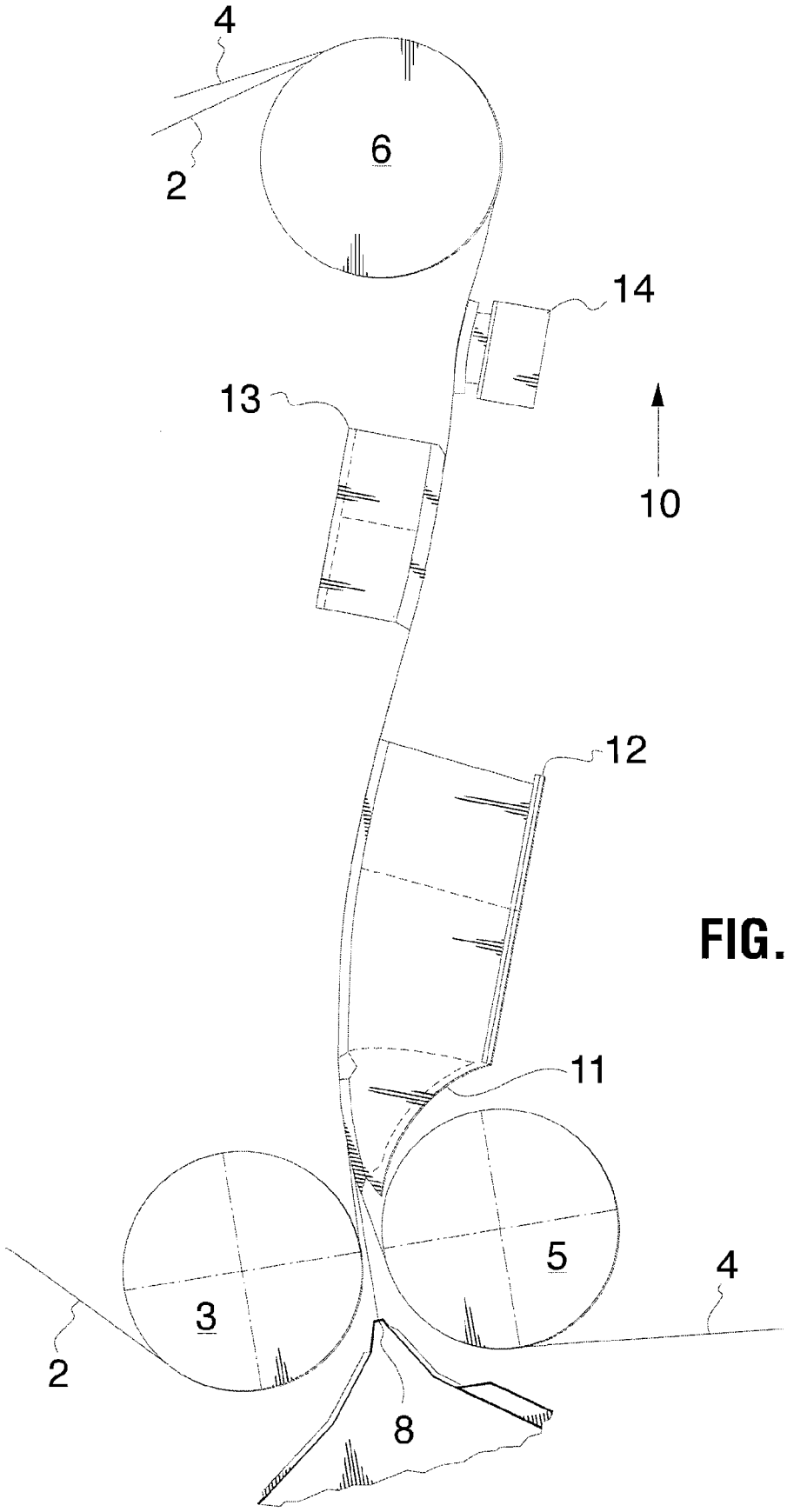

In FIGS. 5, 6 and 7 alternative arrangements are shown for the impingement shoe 11. In FIG. 1*a* slotted shoe as described by Buchanan et al in US 2003/0173048 is used.

FIG. 5 shows the combination of the first dewatering box 11 as seen in FIGS. 1 and 2 which includes the curved impingement shoe surface 33, with the dewatering box 30 as shown in FIG. 4, and which includes the flexibly mounted fabric support elements 31.

The arrangement shown in FIG. 6 shows a conventional impingement shoe 34 carrying a short set of fabric support elements as at 35.

The arrangement of the impingement shoe 11 shown in FIG. 7 again follows the concepts of Buchanan et al, in US 2003/0173048, FIG. 1, but it is located on the other side of the two forming fabrics and is adjacent to the first dewatering box 12. Thus instead of contacting the machine side of the moving forming fabric 2, it is now in contact with the machine side of the forming fabric 4.

Figure 8:
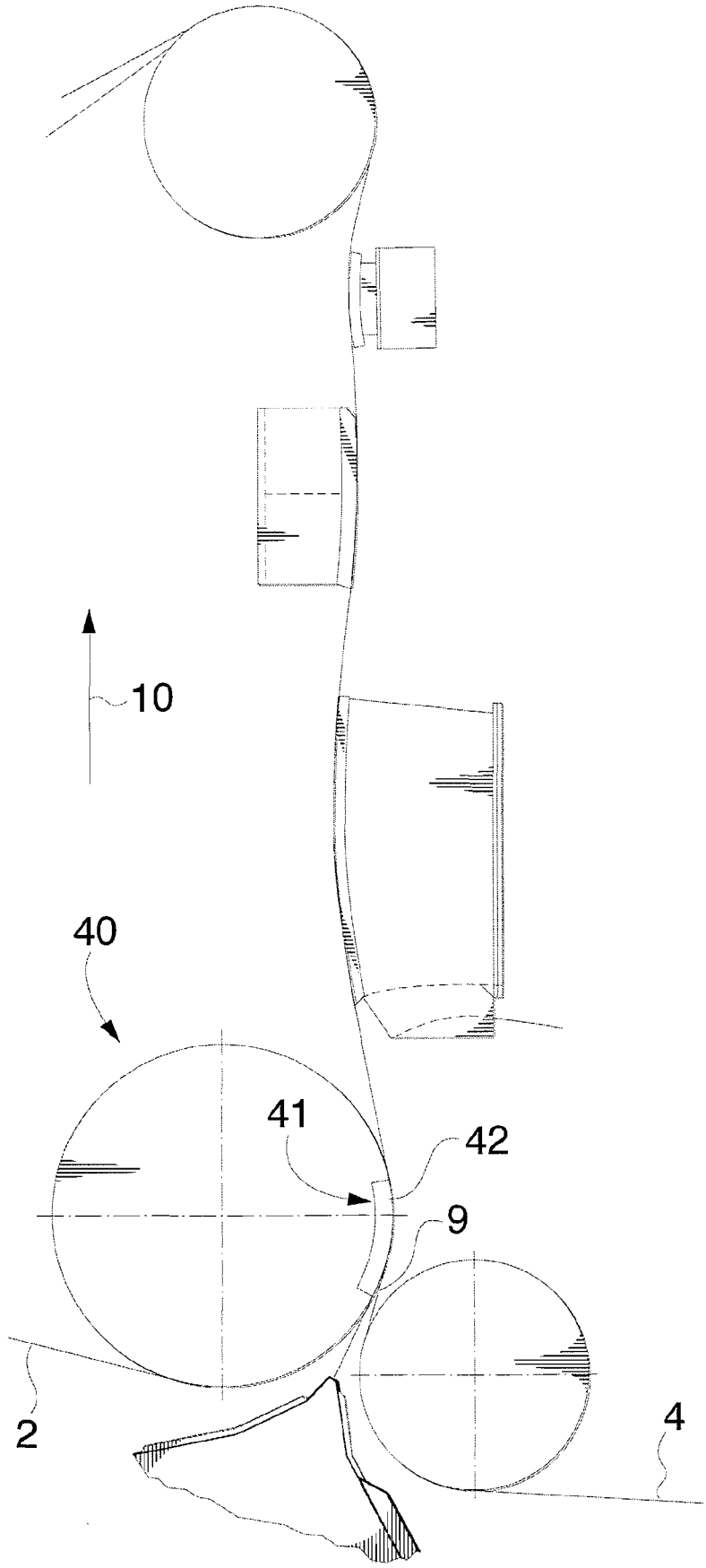
FIG. 8 shows a construction in which an impingement roll is used.

In FIG. 8 a different construction is shown in which an impingement roll 40 is used. The impingement roll 40 is provided with a controlled supply of vacuum (not shown) and includes a vacuum zone as at 41. Evacuated rolls of this type are well known. In this construction, the impingement point 9 of the stock jet is where the two moving forming fabrics 2,4 come into contact on the vacuum roll as at 42.

Figure 9:
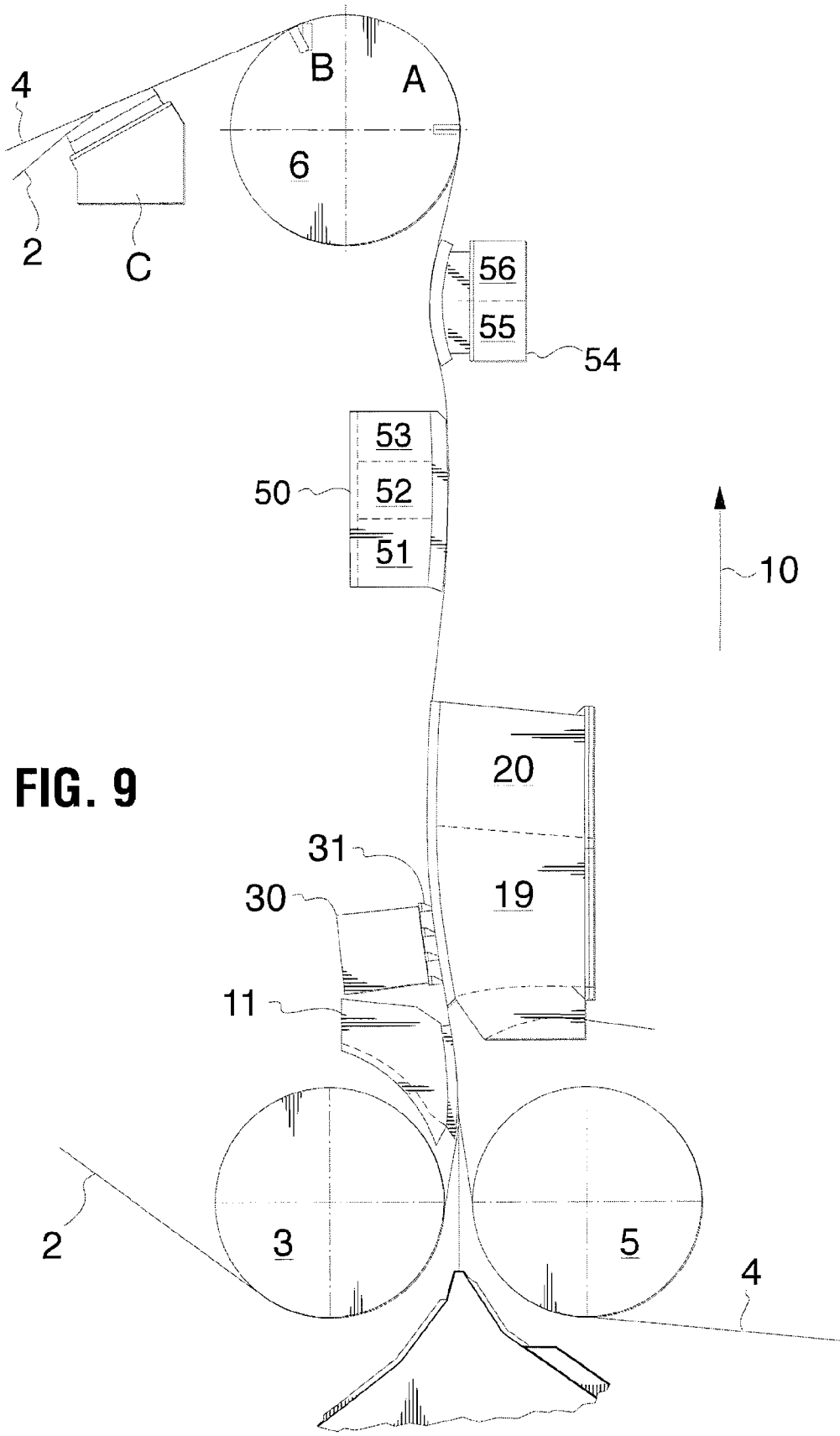
FIG. 9 shows schematically an alternative construction to that shown in FIG. 1.

In FIG. 9 an alternative construction is shown to that of FIG. 1. Comparison with FIG. 1 shows that the opposed dewatering box 30 with its fabric support elements 31 has been incorporated adjacent the box 11. In FIG. 1 the dewatering box 13 has two chambers 21 and 22. In FIG. 9 this dewatering box is replaced by the dewatering box 50 which has three chambers 51, 52 and 53. Also the single dewatering box 14 of FIG. 1 is replaced in FIG. 9 by a dewatering box 54 having two chambers 55 and 56. Further, roll 6 is shown as having vacuum chambers A and B, as would be found on a conventional couch roll. Transfer box C is located downstream of roll 6, where the backing fabric 4 is separated from the conveying fabric 2 carrying the stock layer 7, which proceeds from transfer box C downstream to the press section (not shown). Alternatively, roll 6 can be solid.

Figure 10:
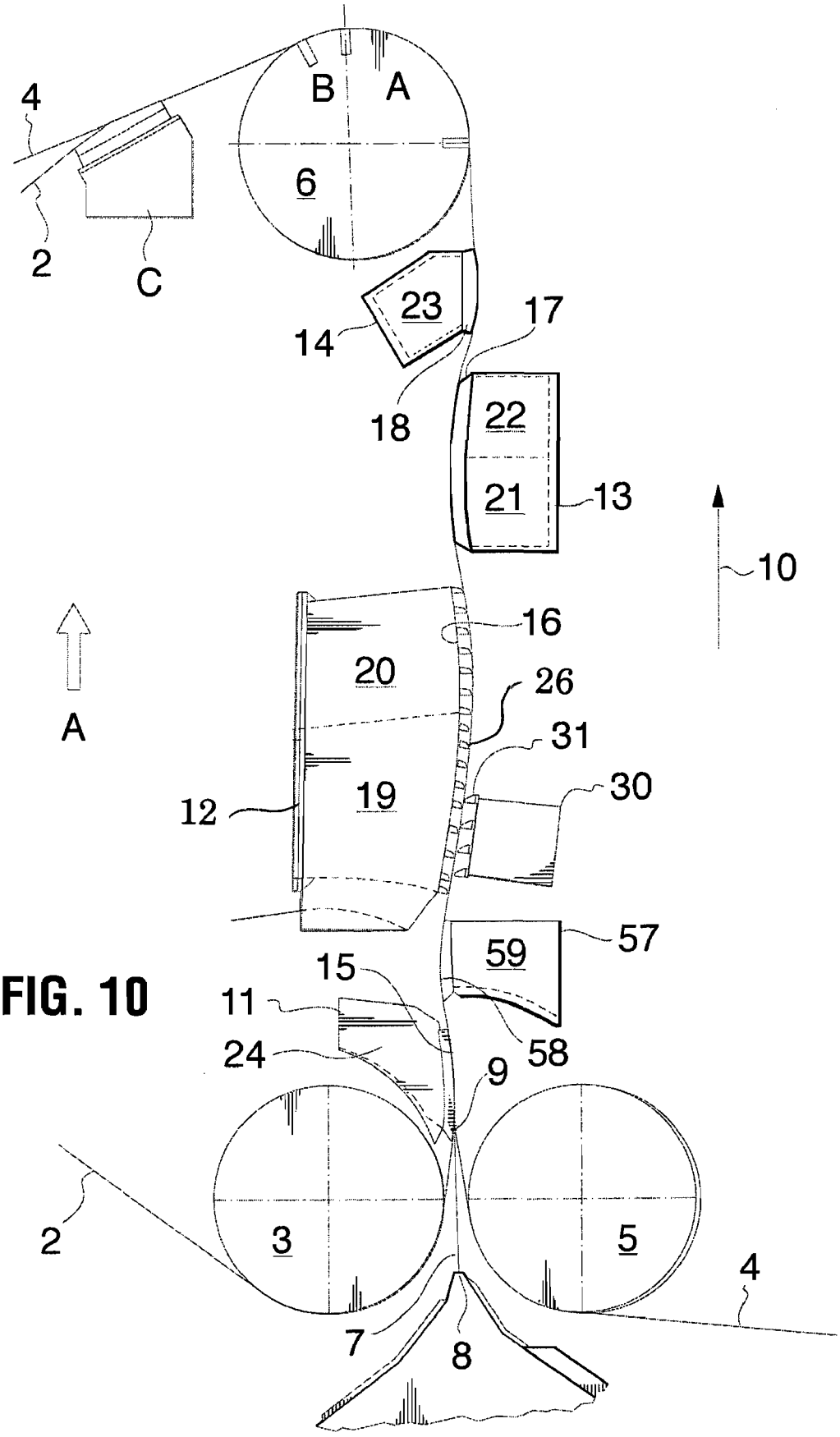
FIG. 10 shows a further alternative construction to that shown in FIG. 1.

In FIG. 10, a further alternative construction to that shown in FIG. 1 is provided. In this version, a second forming shoe 57 is located downstream of dewatering box 11. Forming shoe 57 is preferably provided with a slotted cover 58 and is constructed in accordance with the teachings of Buchanan et al. US 2003/0173048; although other forming shoe designs as are known in the art may also be suitable. Forming shoe 57 is provided with a curved slotted cover 58 and is located so that the fabrics 2 and 4 together with the stock layer 7 follow its contour which is generally the reverse of that of cover 15 on box 11. This reversal of the curvature of the fabric path imparts a pressure pulse into the stock 7 so as to agitate the papermaking fibers. The path of the fabrics 2, 4 is then caused to reverse somewhat again as the fabrics pass together over the curved surface provided by fabric support elements 26 on the cover 16 of dewatering box 12, described above in relation to FIGS. 3 and 4. It is noted that here, the zone 19 of the dewatering box 12 is shown with the pitch of the fabric support elements progressively decreasing in the machine direction. As described in relation to FIG. 4, dewatering box 30 is located opposite dewatering box 12 and is likewise provided with a plurality of fabric support elements 31, located in alternating opposed relation to those on dewatering box 12. The fabrics 2, 4 with the stock 7 sandwiched in between are then caused to curve in the opposite direction over the surface 17 of box 13 in the same manner as is shown in FIG. 1. Following box 13, the fabrics 2, 4 pass together over the surface of the fabric support elements (not shown) located on the cover 18 of box 14. The fabrics 2, 4 then proceed around turning roll 6, which may be solid or partitioned into one or more vacuum chambers A and B as described in relation to FIG. 9. Transfer box C, located downstream of turning roll 6, assists in separating the fabrics 2 and 4 such that the sheet follows conveying fabric 2.

Except as illustrated in FIG. 4A, in the drawings the fabric support elements are all shown schematically to have the same width in the machine direction. In practise, and as noted in connection with FIG. 4A, the fabric support element width may not be the same for all of the dewatering boxes. Some dewatering boxes may require a different width fabric support element just to accommodate the volume of white water which is being drained from the forming fabrics at that location. It is also possible that a different width fabric support element may be required in order to obtain the desired level of pressure pulse with the stock at a given location. Experience shows that the ratio of the width of fabric supporting fabric support elements to the width of the gap between them should be from about 1:10 to about 1:0.5.

In the drawings dewatering boxes are shown which have more than one chamber to each of which a controlled level of vacuum is applied. If the vacuum levels in adjacent chambers or dewatering boxes are not the same, it is desirable that the surface curvatures, and possibly also the corresponding fabric support element pitch, also should not be the same. Furthermore experience shows that it is desirable that the vacuum level in a sequence of dewatering boxes or chambers should increase relatively smoothly in the machine direction. Although the vacuum level can remain constant in two adjacent dewatering boxes or chambers it should not decrease in the machine direction, and furthermore spikes of radically different pressure should be avoided. In other words, all of the variables do not necessarily change smoothly in a step wise fashion; adjacent zones can have the same values for at least some of the variables.

Using a paper making machine having a twin fabric forming section broadly corresponding to that shown schematically in FIG. 9 several newsprint paper samples were made. The vacuum profile shown in Table 1 was found to give improved quality paper in comparison to other paper making machines having a conventional twin fabric forming section. In Table 1 the location numbers refer to the dewatering box chamber and impingement shoe numbering to be found on FIG. 9.

Table 1—the location numbers refer to the dewatering box chamber and impingement shoe numbering to be found on FIG. 9.

TABLE 1

| Location | Vacuum, kPa |
|---|---|
| 11 | 1.2 |
| 20 | 3.8 |
| 51 | 8.5 |
| 52 | 12.2 |
| 53 | 14.6 |
| 55 | 22.6 |
| 56 | 27.9 |
| A | 38.6 |
| B | 51.0 |
| C | 62.1 |

The invention claimed is:

1. A gap type two fabric forming section for a paper making machine having a conveying forming fabric and a backing forming fabric, such that:

(i) each of the forming fabrics has a paper side and a machine side;

(ii) the forming fabrics move together in a machine direction through a forming zone with a layer of stock sandwiched in between;

(iii) the forming fabrics are supported by a series of fabric support elements, chosen from the group consisting of rolls, static fabric contacting fabric support elements and both rolls and static fabric contacting fabric support elements, over which the machine sides of each of the forming fabrics pass in sliding contact, the fabric support elements being supported on a sequence of dewatering boxes, the dewatering boxes having a curved fabric support element supporting surface; and (iv) the dewatering boxes provide separate drainage zones and at least some of the dewatering boxes are connected to a source of vacuum to provide separate vacuum zones, wherein:

(a) the forming zone comprises that portion of the forming section between the locus at which the forming fabrics come together to sandwich the stock between them and the locus at which the two forming fabrics separate with the stock continuing on one of them;

(b) the dewatering boxes provide at least four separate and distinct vacuum zones within the forming zone;

(c) radii of curvature of the curved surfaces supporting the fabric support elements decrease progressively in the machine direction;

(d) a pitch of the fabric support elements decreases progressively in the machine direction; and (e) the dewatering boxes supporting the fabric support elements are selectively located on the machine sides of the first forming fabric and the second forming fabric in an opposed and at least partially offset sequence in the machine direction.

2. A forming section according to claim 1, wherein the pitch of successive fabric support elements within at least one vacuum zone decreases in the machine direction.

3. A forming section according to claim 1, wherein the fabric support elements have a width in the machine direction which decreases progressively in the machine direction.

4. A forming section according to claim 1, wherein the fabric support elements within at least one vacuum zone have a width in the machine direction which decreases progressively in the machine direction.

5. A forming section according to claim 1, wherein each dewatering box provides at least one vacuum zone.

6. A forming section according to claim 5, wherein at least one dewatering box provides at least two vacuum zones.

7. A forming section according to claim 6, wherein each dewatering box provides at least two vacuum zones.

8. A forming section according to claim 6, wherein in each dewatering box which provides at least two vacuum zones, the fabric support element pitch within successive vacuum zones provided by the dewatering box decreases in the machine direction.

9. A forming section according to claim 7, wherein in each dewatering box which provides at least two vacuum zones, the fabric support element pitch within successive vacuum zones provided by the dewatering box decreases in the machine direction.

10. A forming section according to claim 6, wherein in each dewatering box which provides at least two vacuum zones, the radii of curvature of the curved surfaces supporting the fabric support elements within successive vacuum zones provided by the dewatering box decreases in the machine direction.

11. A forming section according to claim 7, wherein in each dewatering box which provides at least two vacuum zones, the radii of curvature of the curved surfaces supporting the fabric support elements within successive vacuum zones provided by the dewatering box decreases in the machine direction.

12. A forming section according to claim 1, wherein the ratio of the width of the fabric support elements to the width of the gap between them varies from about 1:10 to about 1:0.5.

13. A forming section according to claim 1, wherein the forming section further includes a turning roll which is provided with vacuum assisted drainage.

14. A forming section according to claim 1, wherein the forming section further includes a turning roll without vacuum assisted drainage.

* * * * *